United States Patent [19]

White

[11] Patent Number: 4,953,906

[45] Date of Patent: Sep. 4, 1990

[54] GOLF BALL RETRIEVER

[76] Inventor: Charles S. White, 338 Prinz, San Antonio, Tex. 78213

[21] Appl. No.: 337,918

[22] Filed: Apr. 14, 1989

[51] Int. Cl.[5] ..... A63B 47/02

[52] U.S. Cl. ..... 294/19.2; 273/32 F

[58] Field of Search ..... 294/19.2; 273/32 B, 273/32 F, 162 E

[56] References Cited

U.S. PATENT DOCUMENTS

| | | | |
|---|---|---|---|
| 1,674,294 | 6/1928 | O'Rourke . | |
| 2,482,294 | 9/1949 | Sandor . | |
| 2,561,815 | 7/1951 | Oberg . | |
| 3,434,753 | 3/1969 | De Croes | 294/19.2 |
| 4,180,288 | 12/1979 | Sievers | 294/19.2 |
| 4,310,189 | 1/1982 | Nihra . | |
| 4,515,402 | 5/1985 | Sedan . | |
| 4,687,204 | 8/1987 | Lempio | 294/19.2 X |

FOREIGN PATENT DOCUMENTS

| | | | |
|---|---|---|---|
| 216731 | 6/1924 | United Kingdom | 294/19.2 |

*Primary Examiner*—Margaret A. Focarino
*Assistant Examiner*—Dean Kramer

[57] ABSTRACT

A golf ball retriever which is attachable to the grip end of a standard golf club and which retrieves a lost ball in a partial loop at the retriever's end. The partial loop is formed to define approximately 66% of a full circle. For optimum retrieving effectiveness, the partial loop is oriented relative to the supporting shaft where it may be brought closely parallel with the resting surface of the golf ball. The retriever is formed into a spiral configuration at its club attachment end. To attach the retriever to a golf club, the club grip is guided into the center of the spiral configuration to coincide with its axis and then drawn telescopically as far out as permitted by the spiral until the retriever is firmly seated on the grip.

3 Claims, 1 Drawing Sheet

GOLF BALL RETRIEVER

BACKGROUND OF THE INVENTION

1. Field of the Invention

Applicant's invention relates to apparatuses for retrieving golf balls from locations not conveniently or safely accessible via the unassisted reach of one's arm.

2. Background Information

Each year, hundreds of thousands of golf balls find their way into locations not conveniently or safely accessible to the golfer without some means of effectively extending the golfer's reach. There are two consequences of this problem: (1) a number of golf ball retrievers have been developed, and; (2) because of the inconvenience or marginal effectiveness of the available golf ball retrievers a substantial portion of the wayward golf balls are never retrieved or are retrieved by persons other than the original owners.

3. Related Patents

U.S. Pat. No. 4,310,189, issued to J. Nihra, discloses a golf ball retriever the operable portion of which includes a partial loop which occupies approximately 7/8ths of a full circle. Embossments are provided on the interior surfaces of the rod which forms the loop to improve frictional engagement between the retriever and a golf ball. In operation, the Nihra retriever requires that the loop thereof be placed directly over the ball sought to be retrieved. As the retriever is pressed downward, the loop, which has a slightly smaller effective diameter than the maximum diameter of the golf ball, of the golf ball, yields slightly and passes slightly past the midpoint of the golf ball thereby allowing the ball to be lifted from its resting place.

The Nihra retriever has several significant limitations. First, the golf ball must be lying on a relatively hard surface and, secondly, the ball must be clearly visible to the golfer if the golf ball is to be retrieved without extended and frustrating effort. The latter requirement is unsatisfactory because a lost golf ball is often beyond view, such as when in murky water or behind dense foliage. Further, even in clear water, the refraction of water will make precise placement possible only after some trial and error. The former requirement is unacceptable in many environments in which a golf ball is likely to find itself, such as at the bottom of a water trap.

While Nihra does teach scooping under the golf ball in the case of soft surfaces, such is no distinguishing characteristic of the Nihra retriever as any device sufficiently wide can perform such a shovel-like function. Finally, Nihra teaches a telescopic member to which the loop is mounted. Such telescopic members, particularly in the field of golf ball retrievers, are notoriously prone to breakage and rapid wear. This is often the result of the manufacturers recognition that a retriever must be very light weight to be practical and marketable.

U.S. Pat. No. 4,515,402, issued to J. Sedan, teaches a golf ball retriever the operable portion of which is a yielding loop having a resting diameter slightly less than the maximum diameter of a golf ball. Like the Nihra retriever, the Sedan retriever suffers from a limitation of requiring placement directly over the golf ball sought to be retrieved. The limitations associated with this characteristic are the same as those discussed relating to Nihra. An additional limitation of the Sedan design relates to its method of achieving the desired length for a golf ball retriever. While the Sedan design does avoid use of the problematic, telescopic means, it is designed to be fixed to the head end of an iron. It is anticipated that all but the most physically fit and non-arthritic golfers will experience difficulty in maneuvering the retriever with the necessary precision, because of the significant moment of torque provided by this arrangement. In other words, the combined weight of the golf club head and the retriever extending some distance therebeyond, makes the Sedan retriever quite unwieldy.

U.S. Pat. No. 2,482,294, issued to W. Sandor, teaches another yielding, partial loop golf ball retriever. Like Nihra, Sandor effectively teaches a telescopic member for providing the necessary length of the retriever. The problems associated with a yielding loop retriever have already been discussed and will not be repeated at this time.

U.S. Pat. No. 2,561,815, issued to C. Oberg, and U.S. Pat. No. 1,674,294, issued to M. O'Rourke, also teach golf ball retrievers, but their design differs so substantially from applicant's as to be of only marginal relevance. These patents are, however, mentioned in the interest of full disclosure.

SUMMARY OF THE INVENTION

It is an object of the present invention to provide a golf ball retriever which in the retrieving process need not be initially placed in precise proximity to the golf ball sought to be retreived.

It is another object of the present invention to provide a golf ball retriever having no mechanically interactive members to break or become worn.

It is another object of the present invention to provide a golf ball retriever which may be effectively operated without actual visual contact with the lost golf ball.

It is another object of the present invention to provide a golf ball retriever which provides the desirable reach of an effective retriever, but which, in full extension, is lightweight and easy to maneuver.

It is another object of the present invention to provide a golf ball retriever which comprises no moving parts, but which effectively provides a reach desirable of a golf ball retriever in conjunction with any common golf club.

It is another object of the present invention to provide a golf ball retriever which with equal effectiveness retrieves golf balls from hard and soft surfaces alike.

It is another object of the present invention to provide a golf ball retriever which effectively retrieves a golf ball by simply passing the operable end of the retriever over the ball's resting surface from an area adjacent to the ball toward the ball until the ball is contacted and retrieved.

It is another object of the present invention to provide a golf ball retriever which requires neither moving nor resilient yielding members.

In satisfaction of these and related objectives, applicant's invention provides a golf ball retriever with a non-yielding, partial loop at it operable end. The terminus of the loop is cut or formed obliquely to the length of the rod which forms the loop in a manner whereby the distal-most portion of the terminus is situated at the interior surface of the loop. The shaft of the retriever is bent within a short distance of the loop, whereby the loop may be brought closely parallel with a golf ball's horizontal resting surface notwithstanding the other end of the retriever shaft extending from a point several feet above the resting surface.

The retriever of applicant's invention includes a club grip coupler for coupling the retriever to the grip of any standard golf club. In this manner, the golfer holds the head end of the golf club and extends the handle end with the retriever affixed thereto toward the golf ball sought to be retrieved. In this way, the moment of torque provided by the extended golf club and the retriever is reduced to a quite acceptable degree. This in turn allows the golfer to manipulate the retriever with minimal effort or strain.

The preferred embodiment of Applicant's golf ball retriever is made of an aluminum rod which makes it both light and durable. The lack of moving or yielding parts give Applicant's golf ball retriever a near indefinite service life expectancy.

DETAILED DESCRIPTION OF DRAWINGS

Figure 1:
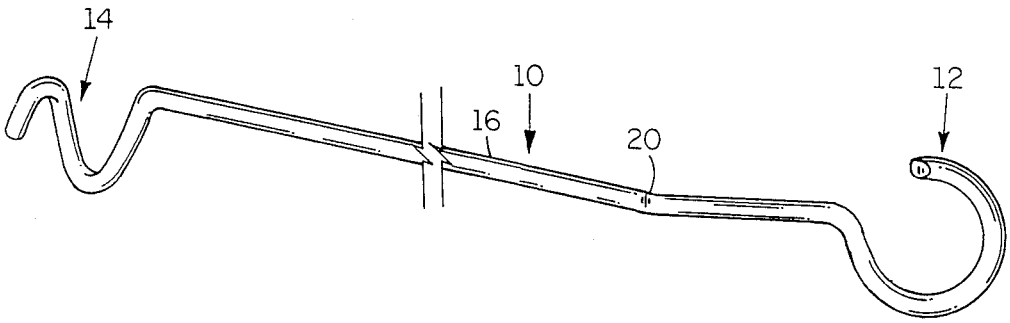
FIG. 1 is a view of the golf ball retriever of applicant's invention with a segment of the central shaft removed for economy of illustration space purposes.

Referring to FIG. 1, the golf ball retriever of applicant's invention is identified by the reference numeral 10. The retriever 10 is formed from metallic shaft (¼" aluminum in the preferred embodiment) and has a partially opened loop 12 at one end and a club grip coupler 14 at the other end. The shaft intervening the loop 12 and the club grip coupler 14 is identified by the reference numeral 16.

The loop 12 in the preferred embodiment originates at its just referenced intersection with the shaft 16 and defines 1.34 pi radians of curvature, or a 66% complete circle. Through exhaustive testing and readjustment, it has been determined that the 66% loop performs optimally for its intended purpose. Conversely, loops of substantially different degrees of closure, such as that taugh by Nihra (88%), performed very poorly, even when made in conjunction with the other elements of applicant's invention as taught herein. While a partial loop 12 of 1.34 pi radians is optimal, variation by approximately five percent (5%) will not completely defeat operation of the retriever completely and should be considered to be within the scope of Applicant's invention.

The partial loop 12 is formed at the end of shaft 16 so that it is "off center" relative to the longitudinal axis of the shaft 16 where the shaft 16 intersects partial loop 12. The precise relative position of the loop 12 to the shaft 16 may be more easily understood by illustratively discussing two imaginary lines and the spatial relationship therebetween. The first imaginary line would coincide with the longitudinal axis of the shaft 16 where it intersects the loop 12. The second imaginary line would run parallel to the first, but would pass through the center point of the circle which is partially defined by loop 12. In the preferred embodiment (taking a top plan view of the partial loop 12 such that the open segment of the loop 12 is situated to the viewer's left) the second imaginary line would be situated to the right of the first imaginary line by a distance equal to one-fourth the diameter of the circle which is partially defined by loop 12.

Figure 2:
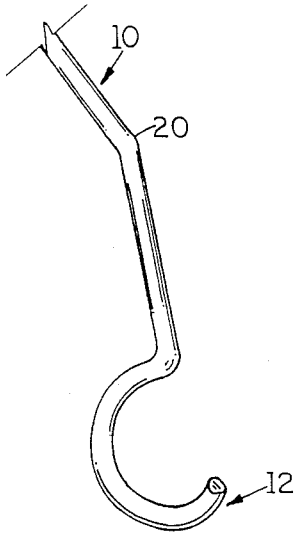
FIG. 2 is a perspective view of the partial loop end of the retriever.

Referring to FIGS. 1 and 2, for discussion purposes as well as in operation, the retriever 10 has distinct upper and lower sides, which are identifiable principally in relation to the bend 20 in the shaft 16. The shaft 16 is bent whereby the loop 12 extends toward the upper side of the retriever 10. The rod on either side of the bend 20 of the preferred embodiment defines an angle of approximately 20°.

Referring again to FIG. 1, the terminus 18 of the loop 12 is cut or ground obliquely relative to the plane in which the loop 12 resides. The cut of the terminus 18 is oriented so a planer face is formed at the terminus 18. The face is oriented whereby the lowermost boundary of the face extends beyond the uppermost boundary of the face. The face is further oriented whereby the above referenced first imaginary line and a line lying at the intersection of the plane defined by the face of the terminus 18 with a plane perpendicular to loop's 12 plane would define an approximately 30° angle. The oblique cut of the terminus 18 has been shown to substantially reduce difficulty of retrieving golf balls with the retriever 10 when oriented as just described.

Figure 3:
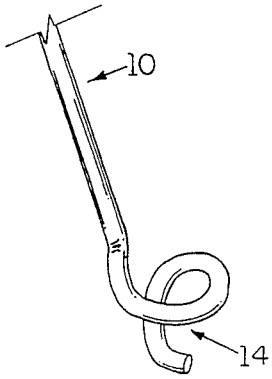
FIG. 3 is a partial perspective view of the club grip coupler end of the retriever.
Figure 4:
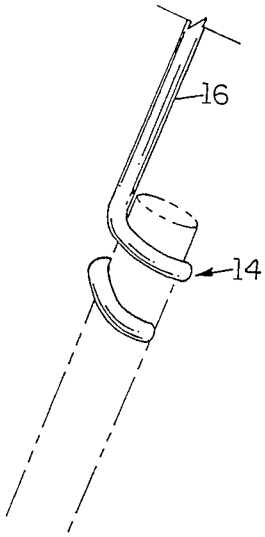
FIG. 4 is a perspective view of the club grip coupler of the retriever properly seated on a golf club grip.

Referring to FIGS. 1, 3 and 4, the club grip coupler 14 is designed to snugly receive the terminal end of any golf club grip. The club grip coupler 14 is the product of a spiral configuration of the metallic rod forming the retriever 10. The spiral of the club grip coupler 14 in the preferred embodiment extends over a distance of approximately 2" as measured parallel with the shaft 16 as it intersects the club grip coupler 14 and turns through approximately 2.5 pi radians. It is noted that the manufactured retriever 10 may have a spiral configuration extending beyond two inches in length, but the minimum curvature should be the indicated approximately 2.5 pi radians.

The shaft 16 between its intersection with the club grip coupler 14 and the bend 20 is approximately 38" in length in the preferred embodiment, however, this length may be extended or retracted without substantial reduction in the benefits provided by the retriever 10. The shaft 16 between the bend 20 and the rod's 16 intersection with the loop 12 is 5" in length in the preferred embodiment, which length has been determined through study and experimentation has been determined to be optimal for most purposes.

Because of the bend 20 in the shaft 16, the plane of the loop 12 will be more closely parallel with the resting surface of the golf ball than if the bend 20 were not present. The relative orientation of the loop 12 with the golf ball's resting surface has been determined to be a critical factor in the optimum performance of the retriever 10. By way of explanation, if the loop 12 is at a substantial angular differential from the resting surface, the terminus 18 is more likely to contact the golf ball relatively high on its surface and push it away. However, when the loop 12 is properly oriented, the terminus 18 merely shepherds the golf ball into the loop 12. This action is aided by the oblique cut of the terminus 18 as above described.

The retriever 10 as above described provides substantial benefits not provided by presently available golf ball retrievers. To attach the retriever 10 to a golf club, the club's grip is guided into the center of the spiral configuration to coincide with its axis and is then drawn telescopically as far out as permitted by the spiral until the retriever is firmly seated on the grip. It is noted that the retriever 10 should not be too firmly seated on the grip however as such would make removing the retriever unduly difficult.

In operation, the loop 12 of the retriever 10 need only be placed (from the user's perspective) to the right of and beyond the ball sought to be retrieved. The retriever is then drawn toward the left and toward the user. When the ball is contacted, it merely rolls along the rod 16 until it is snared by the loop 12. There retriever 10, therefore, make "fishing" for a lost golf ball more than mere chance. If one is in the vicinity of the lost ball, he or she can in most circumstances retrieve the ball. Therefore, the minimal cost of the retriever 10 will be more than offset in cost savings relating to golf balls.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A golf ball retriever comprising a single rod member having a first end being formed into a partial substantially unyielding loop which partially defines a circle, a second end being formed into club grip attachment means for attachment of said golf ball retriever to the end portion of the grip of a golf club and a linear segment which intersects said partial loop and extends from said first end toward said second end;

said partial loop originating at the intersection of said linear segment of said rod with said partial loop and terminating after extending circularly through approximately 1.3 pi radians of curvature, said partial loop being situated off-center relative to said linear segment of said rod member whereby a first imaginary line which coincides with the longitudinal axis of said linear segment of said rod member and a second imaginary line being parallel to the first imaginary line and passing through the center point of said circle are separated by a distance equal to one-fourth of the diameter of said circle;

said first imaginary line delineating a first larger portion of said circle and a second smaller portion of said circle, said second smaller portion of said circle wholly incorporating the arc of said circle left undefined by said partial loop.

2. A golf ball retriever comprising a single rod member having first and second ends, said first end being formed into a partial loop and said second end being formed into club grip attachment means for attachment of said golf ball retriever to the end portion of the grip of a golf club; said partial loop defines approximately 1.3 pi radians of curvature and is positioned and oriented relative to said rod member at said rod member's intersection with said partial loop whereby a first imaginary line coinciding with the longitudinal axis of said rod member at said rod member's intersection with said partial loop intersects a second imaginary line which: (1) is perpendicular to said first imaginary line, (2) lies in the plane defined by said partial loop, and (3) intersects the mid point of the circle which is partially defined by said loop at a point on said second imaginary line one-fourth of the distance from a primary intersection of said second imaginary line with said circle to a secondary intersection of said second imaginary line with said circle, said primary intersection being closest, and said secondary intersection being the most distant relative to said rod member's said intersection with said partial loop.

3. A golf ball retriever comprising a single rod member having first and second ends, said first end being formed into a partial loop which is formed to be substantially coextensive with an imaginary circle over approximately 1.3 pi radians of curvature, said second end being formed into a spiral configuration which passes through approximately 2.5 pi radians and defines a central annulus of approximately $\frac{7}{8}$ of an inch, said spiral configuration for removably attaching said retriever to a grip of a golf club, said rod being bent at a point no less than approximately two inches from said rod's first intersection with said partial loop whereby the segments of said rod lying on either side of the bend defines a 20° angle in a first plane perpendicular to a second plane defined by said partial loop, said retriever having an upper side toward which said rod deviates at said bend and a lower side opposite from said upper side, the terminus of said partial loop being formed to have a face obliquely oriented relative to said second plane, said face being oriented whereby the lowermost edge of said face extends beyond the uppermost edge of said face and wherein a tangent line of said circle at said lowermost edge and a first imaginary line define an approximately 30° angle when said first imaginary line lies at the intersection of said first plane and a third plane defined by said face said partial loop defines approximately 1.3 pi radians of curvature and is positioned and oriented relative to said rod member at said rod member's intersection with said partial loop whereby a first imaginary line coinciding with the longitudinal axis of said rod member at said rod member's intersection with said partial loop intersects a second imaginary line which: (1) is perpendicular to said first imaginary line, (2) lies in the plane defined by said partial loop, and (3) intersects the mid point of the circle which is partially defined by said loop at a point on said second imaginary line one-fourth of the distance from a primary intersection of said second imaginary line with said circle to a secondary intersection of said second imaginary line with said circle, said primary intersection being closet, and said secondary intersection being the most distant relative to said rod member's said intersection with said partial loop.

* * * * *